US012402668B2

(12) United States Patent
Fatuova

(10) Patent No.: US 12,402,668 B2
(45) Date of Patent: Sep. 2, 2025

(54) SPORTS BRA FOR FEMALE WRESTLERS

(71) Applicant: Bustz LLC, Ramsey, NJ (US)

(72) Inventor: Reeve Fatuova, Ramsey, NJ (US)

(73) Assignee: Bustz LLC, Ramsey, NJ (US)

( * ) Notice: Subject to any disclaimer, the term of this patent is extended or adjusted under 35 U.S.C. 154(b) by 0 days.

(21) Appl. No.: 18/596,181

(22) Filed: Mar. 5, 2024

(65) Prior Publication Data

US 2024/0315358 A1 Sep. 26, 2024

Related U.S. Application Data

(60) Provisional application No. 63/453,871, filed on Mar. 22, 2023.

(51) Int. Cl.
*A41C 3/00* (2006.01)

(52) U.S. Cl.
CPC ..... *A41C 3/0057* (2013.01)

(58) Field of Classification Search
CPC ..... A41C 3/0057
See application file for complete search history.

(56) References Cited

U.S. PATENT DOCUMENTS 4,607,640 A * 8/1986 McCusker ..... A41C 3/0057 450/1
5,022,887 A * 6/1991 Lawson ..... A41C 3/0057 450/32
6,083,080 A * 7/2000 Lawson ..... A41C 3/10 450/39
6,110,005 A * 8/2000 Stephenson ..... A41C 3/0057 450/39
6,688,942 B2 * 2/2004 Holliday ..... A41C 3/142 450/39
8,439,721 B2 5/2013 Sokolowski et al.
8,465,341 B2 * 6/2013 Shashy ..... A41C 3/0057 450/39
8,777,693 B2 * 7/2014 Shashy ..... A41C 3/0057 450/65
10,201,192 B1 2/2019 Lott
10,321,723 B2 6/2019 Kelley et al.
11,304,460 B1 4/2022 Biscuiti et al.
11,406,141 B2 * 8/2022 Lucas Gaus ..... A41C 3/10
11,684,092 B2 * 6/2023 Roddis ..... A41C 3/0057 2/243.1
12,133,563 B2 * 11/2024 Young ..... A41C 3/0057
2015/0189927 A1 7/2015 Bunting
2020/0323278 A1 * 10/2020 Roddis ..... A41C 3/005
2022/0361592 A1 11/2022 Cote et al.

* cited by examiner

*Primary Examiner* — Gloria M Hale
(74) *Attorney, Agent, or Firm* — NEO IP

(57) ABSTRACT

A garment for support and compression of a wearer's breasts during high-contact physical activity. The garment includes a bust panel covering the sternal region of the wearer. Elongated underarm sections of the garment provide coverage for the underarm region of the wearer. Two underarm panels are operable to be coupled to the bust panel. The garment further includes back straps in a cross-back configuration, wherein the crossed straps are individually movable and not coupled together. The garment further includes a fully circumferential waistband, wherein the bust panel and underarm panels are attached to the waistband. The bust panel comprises a layer of padded material between at least two layers of flexible fabric. The garment further includes nonslip zones on the interior surface of the flexible fabric.

18 Claims, 13 Drawing Sheets

SPORTS BRA FOR FEMALE WRESTLERS

CROSS REFERENCES TO RELATED APPLICATIONS

This application claims priority to and the benefit of U.S. Provisional Patent Application No. 63/453,871, filed Mar. 22, 2023, which is incorporated herein by reference in its entirety.

BACKGROUND OF THE INVENTION

1. Field of the Invention

The present invention relates to athletic wear for chest compression, and more specifically to sports bras for use in wrestling and high contact activities.

2. Description of the Prior Art

It is generally known in the prior art to provide a compressive garment for support and comfort during physical activity.

Prior art patent documents include the following:

U.S. Pat. No. 11,304,460 for Sports Bra With Collarbone Protective Padding by inventors Biscuiti et al., filed Jan. 8, 2019 and issued Apr. 19, 2022 is directed to a protective shirt including a chest portion made of garment material including a lining on a side of the chest portion that is closest to a wearer of the protective shirt. At least one layer of neoprene is securely fastened to the lining. The at least one layer of neoprene extends from a left side of the chest portion to a right side of the chest portion, and is located at an area of the chest portion nearest to a clavicle of a wearer of the protective shirt. The at least one layer of neoprene includes a plurality of spaced-apart segments of the at least one layer of neoprene. The protective shirt includes a neoprene neck pad. Embodiments of the protective shirt include cap-sleeve, short sleeve, long sleeve, sleeveless and tank top versions. In one embodiment, the garment material includes nylon and spandex.

US Pub No. 2015/0189927 for Protective Garment for Weightlifting by inventor Bunting, filed Sep. 18, 2014 and published Jul. 9, 2015, is directed to a garment for protection of a weightlifter from impact from or contact with a weight bar or barbell. The garment may include one or more padding strip members on the anterior, dorsal, and/or top surfaces and positioned over those areas of a wearer's body contacted by a weight bar or barbell when performing certain lifts. A padding strip member may comprise a hollow member into which is placed a cushioning member configured to absorb or dissipate an impact. The outer surface of a padding strip member may be configured to prevent slippage while the bar or barbell is held in contact with the outer surface. The garment may be manufactured from one or more stretchable materials such that the garment fits snuggly against a wearer's body, and the one or more padding strip members are configured to allow for unimpeded movement while performing weightlifting or other exercise activities.

US Pub No. 2022/0361592 for Sports Bra with Impact Padding by inventors Cote et al., filed May 11, 2022 and published Nov. 17, 2022, is directed to an impact resistant unitary brassiere including a first fabric layer coupled to a second fabric layer and an impact force absorbing pad embedded between the fabric layers. The pad rests in use over a wearer's bony regions. The bony regions may include a clavicle, a thoracic vertebra, or both. The bra may be worn daily by itself or under a shirt to support the clavicle and thoracic spinal and to prevent injuries during any type of physical activity such as may be caused by barbell impact.

US Pub No. 2020/0323278 for Pullover Bra by inventors Roddis et al., filed Jan. 1, 2020 and published Oct. 15, 2020, is directed to pullover bras for high support activities. A bra includes a band that wraps around the torso. The band includes first and second cup regions as well as a gore adjoining the cup regions. An underband runs below the gore and the cup regions. Straps adjoin a respective cup region and a respective portion of the band. A neckline runs above the cup regions and between a first portion of each strap. The gore and underarm portions of the band are formed from a first pattern of fabric. The back of the bra, the straps, and the neckline is formed from a second pattern of fabric. The underband is formed from a third pattern of fabric.

U.S. Pat. No. 8,439,721 for Grooved Support Sports Bra by inventors Sokolowski et al., filed Oct. 19, 2010 and issued May 13, 2013, is directed to sport bras having one or more support grooves for lifting, separating, shaping a supporting a wearer's breasts and methods for fabricating these sport bra. The support grooves may be pressed into a layer of compressible material such that the support grooves extend from a central region along the wearer's sternum, curve underneath the breasts and extend upwardly towards the underarm region.

U.S. Pat. No. 10,321,723 for Free Motion Sports Bra by inventors Kelley et al., filed Oct. 16, 2017 and issued Jun. 18, 2019, is directed to an article, such as sports bras, and methods of making the same. A sports bra may comprise a front panel comprising a bust panel, a first shoulder strap, and a second shoulder strap. The sports bra may comprise a rear panel comprising a first back strap and a second back strap. The first back strap may coupled to the first shoulder strap at a first shoulder seam and the second back strap may coupled to the second shoulder strap at a second shoulder seam. The first back strap may be coupled to the bust panel at a first side seam and the second back strap may be coupled to the bust panel at a second side seam. One or both of the back straps may have the second a curve-linear shape exhibiting a tapered width.

U.S. Pat. No. 10,201,192 for Sports Bra by inventor Lott, filed Jun. 20, 2016 and issued Feb. 12, 2019, is directed to a sports bra that has base and cover layers of four-way stretchable material providing a first level of radial compression to the torso, a wide elastic band gripping the midriff to resist rotational and vertical motion of the bra relative to the torso and crisscrossed bands of elastic material spanning the back portion of the bra. Laterally-stretchable, vertically-shape-retaining foam panels overlap the base layer to support the breasts from below and power-mesh is sandwiched between the base and cover layers to increase radial compression of the breasts from above. The components all cooperate to limit bounce of the breasts during vigorous physical activity by the wearer. Adjustable shoulder straps and a zippered front are optional.

SUMMARY OF THE INVENTION

The present invention relates to sports bras for compression and support of a wearer's breasts during full-contact sports. The present invention also relates to sports bras that allow free movement of the wearer's upper body, specifically the shoulders, arms, scapulae, upper back muscles, and lateral muscles.

It is an object of this invention to provide a compressive sports bra that does not limit the range of motion of the wearer or slip during activity. Many prior art garments rely on harsh, constrictive edges to dig into the skin and prevent movement of the garment during activity. Additionally, the compression provided by the prior art limits the movement of the wearer.

In one embodiment, the present invention is a garment for chest compression and support, comprising a bust panel, a waistband, a first underarm panel and a second underarm panel, and a first back strap and a second back strap, wherein the bust panel comprises a first layer, a second layer, and a third layer, wherein the first layer and the third layer comprises a stretchable fabric and the second layer comprises a padding material, wherein the bust panel further comprises a continuous stitched outline of an under bust region of the garment, wherein the first backstrap is not coupled to the second backstrap, wherein the first back strap moves independently of the second backstrap in a crisscross orientation, wherein the waistband fully encircles the waist of a wearer, wherein the first underarm panel is coupled to the waistband and the bust panel, wherein the second underarm panel is coupled to a side of the bust panel opposite the first underarm panel, wherein the first underarm panel is not coupled to the second underarm panel, and wherein the garment includes at least one nonslip zone, wherein the nonslip zone comprises a fabric with a higher coefficient of friction than the stretchable fabric.

In another embodiment, the present invention is a garment for chest compression and support, comprising a bust panel, a waistband, a first underarm panel with a first elongated section, a second underarm panel with a second elongated section, and a first back strap and a second back strap, wherein the bust panel comprises a first layer, a second layer, and a third layer, wherein the first layer and the third layer comprises a stretchable fabric and the second layer comprises polyurethane padding, wherein the bust panel further comprises a continuous stitched outline of an under bust region of the garment, wherein the first backstrap is not coupled to the second backstrap, wherein the first back strap moves independently of the second backstrap in a crisscross orientation, wherein the waistband fully encircles the waist of a wearer, wherein the first underarm panel is coupled to the waistband and the bust panel, wherein the second underarm panel is coupled to a side of the bust panel opposite the first underarm panel, wherein the first underarm panel is not coupled to the second underarm panel, wherein the first elongated section extends upward from the first underarm panel, wherein the second elongated section extends upward from the second underarm panel, wherein the garment includes a plurality of nonslip zones, wherein each of the plurality of nonslip zones comprise a fabric with a higher coefficient of friction than the stretchable fabric, wherein a first nonslip zone of the plurality of nonslip zones is located on the hemline of the first elongated section, wherein a second nonslip zone of the plurality of nonslip zones is located on the hemline of the second elongated section, wherein a third nonslip zone of the plurality of nonslip zones is located on the first back strap, and wherein a fourth nonslip zone of the plurality of nonslip zones is located on the second back strap.

In yet another embodiment, the present invention is a garment for chest compression and support, comprising a bust panel, a waistband, a first underarm panel with a first elongated section, a second underarm panel with a second elongated section, and a first back strap and a second back strap, wherein the bust panel comprises a first layer, a second layer, and a third layer, wherein the first layer comprises a stretchable fabric, the second layer comprises polyurethane padding, and the third layer comprises a moisture-wicking fabric, wherein the bust panel further comprises a continuous stitched outline of an under bust region of the garment, wherein the bust panel further comprises a neckline, wherein the neckline of the bust panel is coupled to the first back strap and the second back strap, wherein the first backstrap is not coupled to the second backstrap, wherein the first back strap moves independently of the second backstrap in a crisscross orientation, wherein the waistband fully encircles the waist of a wearer, wherein the waistband comprises an elastic fabric, wherein an inferior edge of the waistband is scalloped, wherein the first underarm panel is coupled to the waistband and the bust panel, wherein the second underarm panel is coupled to a side of the bust panel opposite the first underarm panel, wherein the first underarm panel is not coupled to the second underarm panel, wherein the first elongated section extends upward from the first underarm panel, wherein the second elongated section extends upward from the second underarm panel, wherein the garment includes a plurality of nonslip zones, wherein each of the plurality of nonslip zones comprise a fabric with a higher coefficient of friction than the stretchable fabric, wherein a first nonslip zone of the plurality of nonslip zones is located on the hemline of the first elongated section, wherein a second nonslip zone of the plurality of nonslip zones is located on the hemline of the second elongated section, wherein a third nonslip zone of the plurality of nonslip zones is located on the first back strap, and wherein a fourth nonslip zone of the plurality of nonslip zones is located on the second back strap.

These and other aspects of the present invention will become apparent to those skilled in the art after a reading of the following description of the preferred embodiment when considered with the drawings, as they support the claimed invention.

DETAILED DESCRIPTION

Figure 1A:
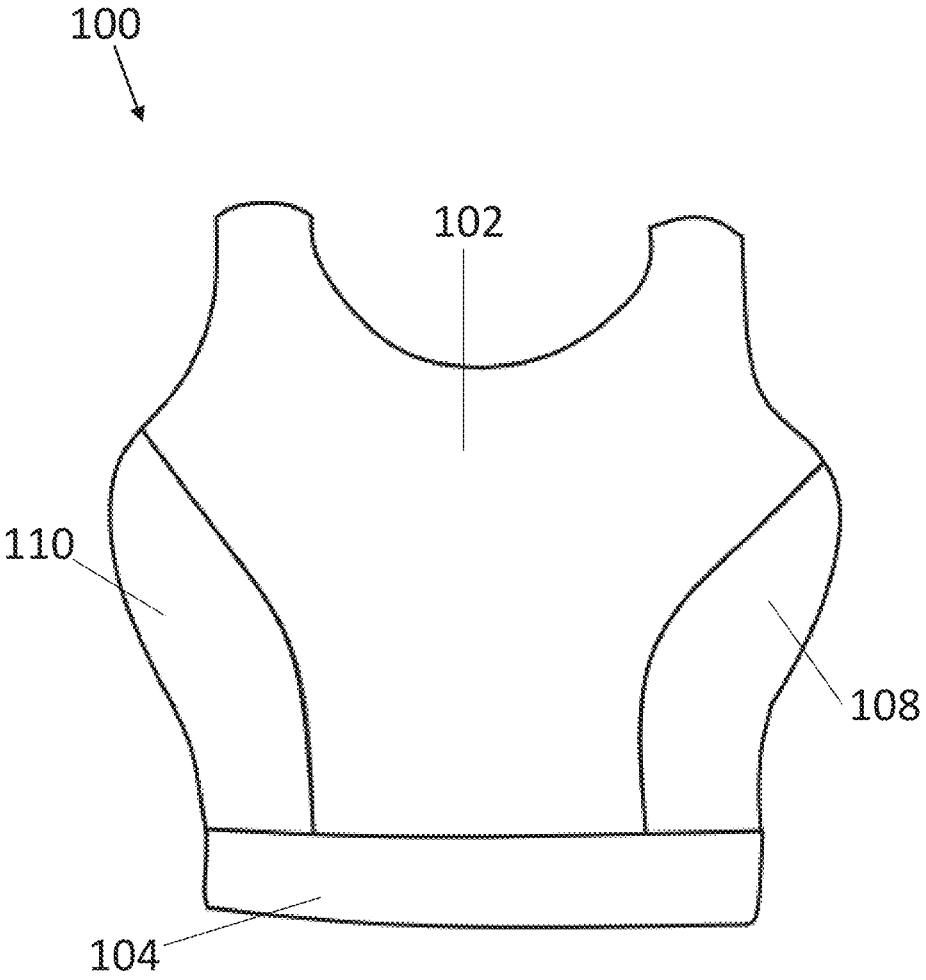
FIG. 1A illustrates an orthogonal view of the front of the garment according to one embodiment of the present invention.

The present invention is generally directed to sports bras for compression and support of a wearer's breasts during full-contact sports. The present invention also relates to sports bras that allow free movement of the wearer's scapulae, upper back muscles, and lateral muscles.

In one embodiment, the present invention is a garment for chest compression and support, comprising a bust panel, a waistband, a first underarm panel and a second underarm panel, and a first back strap and a second back strap, wherein the bust panel comprises a first layer, a second layer, and a third layer, wherein the first layer and the third layer comprises a stretchable fabric and the second layer comprises a padding material, wherein the bust panel further comprises a continuous stitched outline of an under bust region of the garment, wherein the first backstrap is not coupled to the second backstrap, wherein the first back strap moves independently of the second backstrap in a crisscross orientation, wherein the waistband fully encircles the waist of a wearer, wherein the first underarm panel is coupled to the waistband and the bust panel, wherein the second underarm panel is coupled to a side of the bust panel opposite the first underarm panel, wherein the first underarm panel is not coupled to the second underarm panel, and wherein the garment includes at least one nonslip zone, wherein the nonslip zone comprises a fabric with a higher coefficient of friction than the stretchable fabric.

In another embodiment, the present invention is a garment for chest compression and support, comprising a bust panel, a waistband, a first underarm panel with a first elongated section, a second underarm panel with a second elongated section, and a first back strap and a second back strap, wherein the bust panel comprises a first layer, a second layer, and a third layer, wherein the first layer and the third layer comprises a stretchable fabric and the second layer comprises polyurethane padding, wherein the bust panel further comprises a continuous stitched outline of an under bust region of the garment, wherein the first backstrap is not coupled to the second backstrap, wherein the first back strap moves independently of the second backstrap in a crisscross orientation, wherein the waistband fully encircles the waist of a wearer, wherein the first underarm panel is coupled to the waistband and the bust panel, wherein the second underarm panel is coupled to a side of the bust panel opposite the first underarm panel, wherein the first underarm panel is not coupled to the second underarm panel, wherein the first elongated section extends upward from the first underarm panel, wherein the second elongated section extends upward from the second underarm panel, wherein the garment includes a plurality of nonslip zones, wherein each of the plurality of nonslip zones comprise a fabric with a higher coefficient of friction than the stretchable fabric, wherein a first nonslip zone of the plurality of nonslip zones is located on the hemline of the first elongated section, wherein a second nonslip zone of the plurality of nonslip zones is located on the hemline of the second elongated section, wherein a third nonslip zone of the plurality of nonslip zones is located on the first back strap, and wherein a fourth nonslip zone of the plurality of nonslip zones is located on the second back strap.

In yet another embodiment, the present invention is a garment for chest compression and support, comprising a bust panel, a waistband, a first underarm panel with a first elongated section, a second underarm panel with a second elongated section, and a first back strap and a second back strap, wherein the bust panel comprises a first layer, a second layer, and a third layer, wherein the first layer comprises a stretchable fabric, the second layer comprises polyurethane padding, and the third layer comprises a moisture-wicking fabric, wherein the bust panel further comprises a continuous stitched outline of an under bust region of the garment, wherein the bust panel further comprises a neckline, wherein the neckline of the bust panel is coupled to the first back strap and the second back strap, wherein the first backstrap is not coupled to the second backstrap, wherein the first back strap moves independently of the second backstrap in a crisscross orientation, wherein the waistband fully encircles the waist of a wearer, wherein the waistband comprises an elastic fabric, wherein an inferior edge of the waistband is scalloped, wherein the first underarm panel is coupled to the waistband and the bust panel, wherein the second underarm panel is coupled to a side of the bust panel opposite the first underarm panel, wherein the first underarm panel is not coupled to the second underarm panel, wherein the first elongated section extends upward from the first underarm panel, wherein the second elongated section extends upward from the second underarm panel, wherein the garment includes a plurality of nonslip zones, wherein each of the plurality of nonslip zones comprise a fabric with a higher coefficient of friction than the stretchable fabric, wherein a first nonslip zone of the plurality of nonslip zones is located on the hemline of the first elongated section, wherein a second nonslip zone of the plurality of nonslip zones is located on the hemline of the second elongated section, wherein a third nonslip zone of the plurality of nonslip zones is located on the first back strap, and wherein a fourth nonslip zone of the plurality of nonslip zones is located on the second back strap.

None of the prior art discloses a sports bra with a bust panel coupled to two downward-angled underarm panels where the bust panel and the underarm panels are constructed of different compositions of fabric, where the underarm panels are further coupled to two crisscrossed back straps that move independently of each other. Further, none of the prior art discloses the use of nonslip zones on the interior surface of the elongated panels to prevent movement of the fabric during physical activity. Additionally, none of the prior art discloses elongated underarm sections (i.e., the fabric covers the entire underarm rather than only a portion) for decreased lateral constriction and increased coverage of the wearer. Further still, none of the prior art discloses a scalloped waistband to prevent circular constriction during torsional movement.

History is rich with stories of women competing in high-contact sports, such as the Ancient Spartan women who were taught to wrestle in schools and the Mongolian princess Khutulun who challenged her suitors to wrestling matches. However, women were not allowed entry into the modern competitive wrestling circuit until the early 1980's. Their participation raised the important question of how women should be uniformed for such an event. Men's wrestling singlets were created to be functional and utilitarian. As such, the singlets lacked the necessities of a woman's garment. Specifically, the existing wrestling uniform lacked the features necessary to compress and support a woman's breasts during high-contact physical activity while still allowing movement of the necessary anatomy.

The movements of wrestling and similar contact sports require the use of the scapulae (i.e., the shoulder blades) and associated scapular muscles, the trapezius muscle of the upper back, erector spinae muscles along the spine, and the latissimus dorsi muscle located on the sides of the torso, among various others. Much of the prior art has attempted to design garments for women that have a compressive effect due to the amount of fabric that encircles the torso, with a singular back panel that covers the spine of the wearer. Specifically, garments of the prior art compress not only the wearer's bust, but also the spine of a wearer. The back panel of garments of the prior stretches under the arms and over the spine of the wearer. The immobility of this back panel of fabric limits the movement of the scapulae and muscle groups previously mentioned. This style of sports bra, known as a racerback style, places considerable force on the trapezius, spine, scapula, and surrounding muscles. This hinders mobility, as more force is required to move the compressed muscles resulting in increased rates of fatigue and muscle stiffness.

Many prior art systems rely on linear elastic waistbands to prevent upward movement of the sports bra during activity. These elastic waistbands indent into the skin in a solid line around the wearer's waist, effectively constricting both torsional movement and blood flow. The linear elastic compresses the skin of the wearer in a solid circumference of the torse, constricting painfully and leaving an indented line in the skin after removal of the garment. The present invention advantageously utilizes a scalloped waist band in one embodiment to evenly distribute compressive force along a wearer's skin while allowing for blood flow to and from the torso region. Further, the present invention utilizes a multitude of nonslip zones to prevent movement of the waistband without relying on harsh constriction to prevent movement, as in the case of the prior art. Further, the waistband of the present invention encircles the entirety of the wearer's torso to secure the bust panel to the skin and provide sufficient compression without constricting the movement of the wearer.

Further, many prior art systems fail to provide sufficient coverage along the side of a wearer's breast while enabling movement of the lateral muscles. Wrestling positions require stances such as neutral position, wherein the torso of the wearer is angled significantly downward. In positions such as this, sports bras of the prior art do not fully cover the skin of the wearer, making displacement of the breasts more likely as the angle of the wearer changes (i.e., moving from neutral position to grappling on the floor). This displacement causes discomfort and requires a wearer to reposition the garment between moves. This takes the focus away from an opponent, allowing the opponent to take advantage of the opening to initiate a takedown. Further, when grappling with an opponent, the limited fabric on the sports bras of the prior art allows for shifting of a wearers' breasts within the garment, making movement painful for the wearer. Further still, shorter side panels are limited in coverage. Angling of the upper body and arms during certain activities (i.e., sports and combat activities) requires more coverage (i.e., the amount of skin that is covered by the garment) than is provided by traditionally shorter side panels, meaning a user would not have full coverage during such movements and activities.

Referring now to the drawings in general, the illustrations are for the purpose of describing one or more preferred embodiments of the invention and are not intended to limit the invention thereto.

Figure 1B:
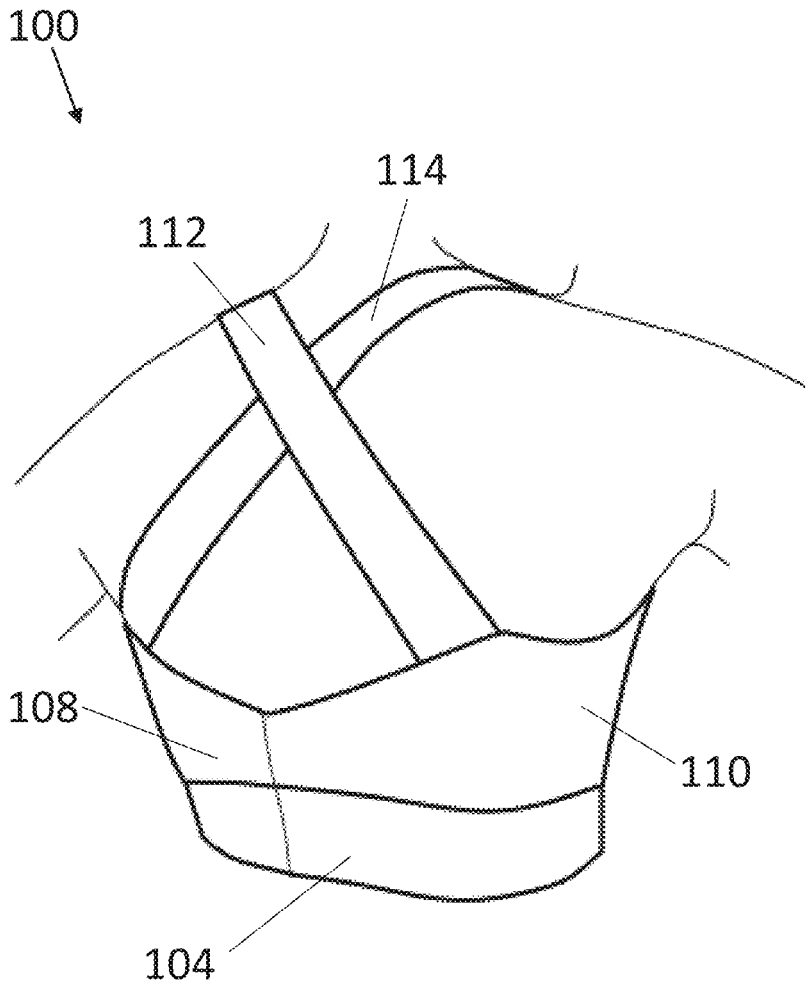
FIG. 1B illustrates a perspective view of the back of the garment on a body of a user according to one embodiment of the present invention.
Figure 1C:
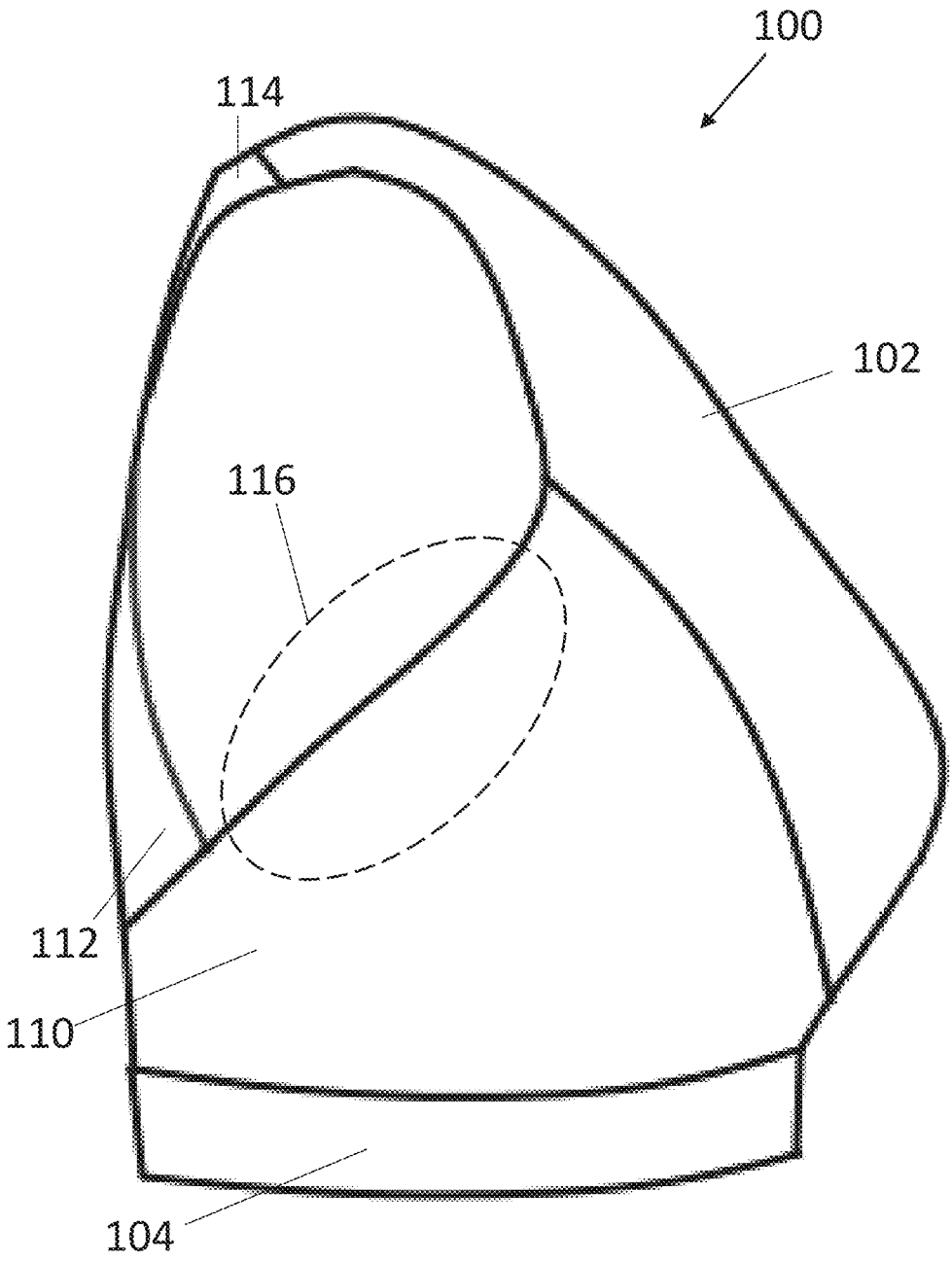
FIG. 1C illustrates an orthogonal view of the side of the garment according to one embodiment of the present invention.

FIGS. 1A-1C illustrate a garment according to one embodiment of the present invention. The garment 100 comprises a bust panel 102 coupled to underarm panels 108, 110. The bust panel 102 and underarm panels 108, 110 are coupled to the waistband 104. The waistband 104 and the under arm panels circumscribe the torso of the wearer. The back of the garment as depicted in FIG. 1B displays the underarm panels 108, 110 coupled together to form a continuous garment. The backstraps 112, 114 are coupled to the underarm panels 108, 110 behind the back of the wearer and stretch over the back of the wearer in a crisscross orientation before coupling to the bust panel on the shoulder of the wearer as depicted in FIG. 1C. The underarm section 116 of the garment is elongated in comparison to garment of the prior art, extending coverage of the bust panel over the pectoral and latissimus dorsi muscles of the wearer. This advantageously provides increased coverage and support to the wearer during physical activity.

In one embodiment, when the wearer is standing in an upright position, the backstraps cross over the area corresponding to any of the thoracic vertebrae. In one embodiment, the backstraps cross over an area covering multiple thoracic vertebrae. In one embodiment, when the wearer is standing in an upright position, the backstraps cross over the area corresponding to the T3, T4, T5, T6, T7, T8, T9 and/or T10 thoracic vertebrae.

Figure 2A:
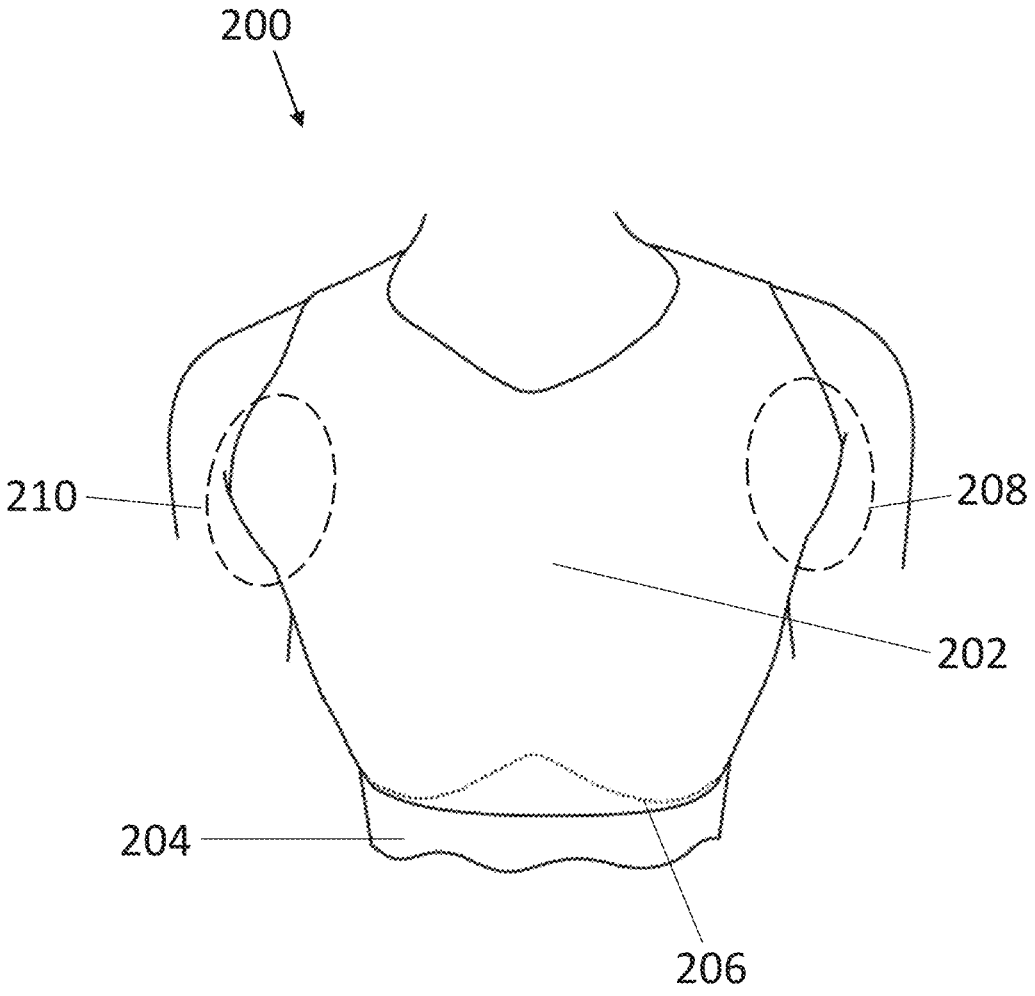
FIG. 2A illustrates an orthogonal view of the front of the garment on a body of a user according to one embodiment of the present invention.
Figure 2B:
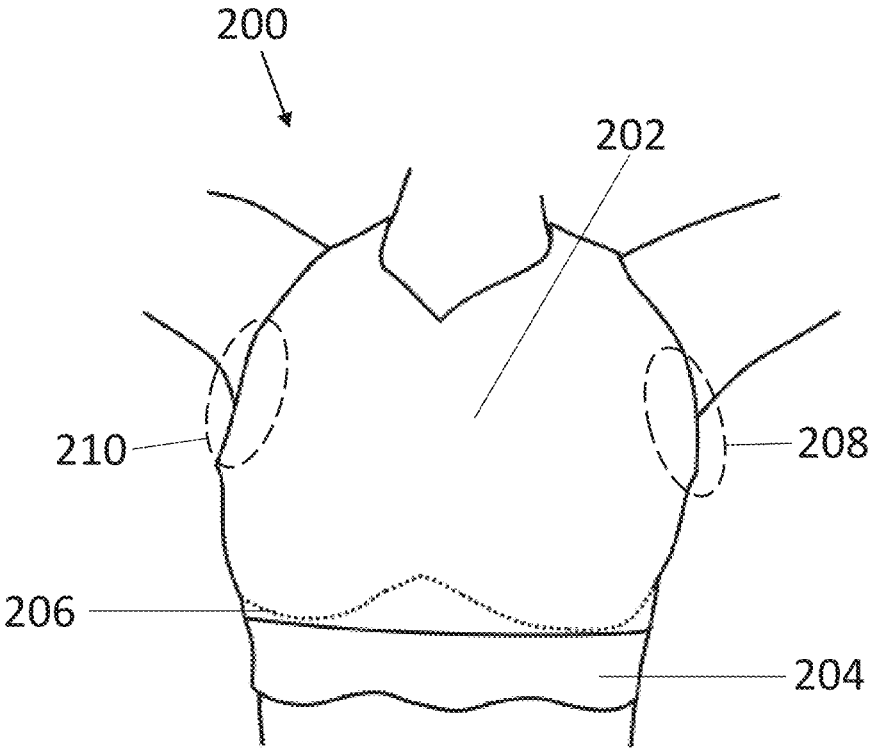
FIG. 2B illustrates an orthogonal view of the front of the garment on a body of a user according to one embodiment of the present invention.
Figure 2C:
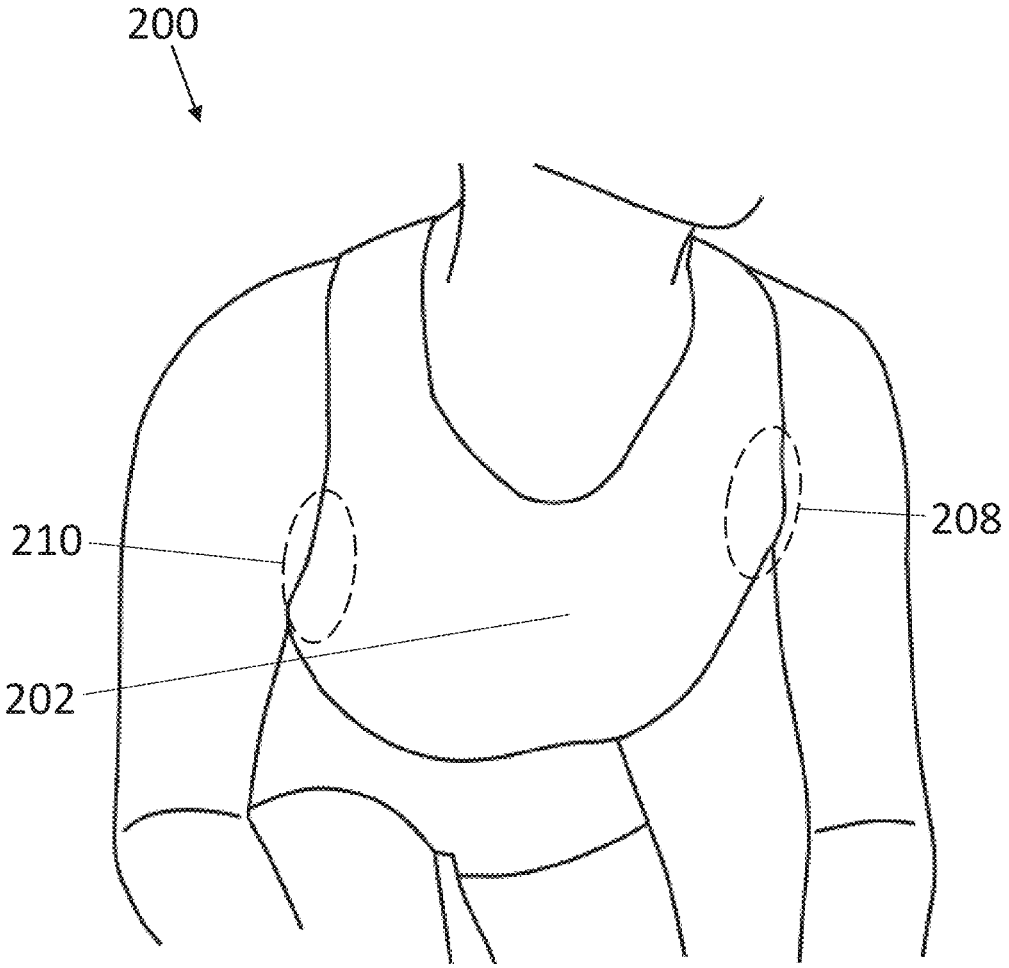
FIG. 2C illustrates a perspective view of the front of the garment on a body of a user according to one embodiment of the present invention.

FIGS. 2A-2E illustrate a garment according to one embodiment of the present invention. FIGS. 2A-2C depict the front of the garment according to one embodiment of the present invention. FIG. 2A depicts the exterior of the garment 200 when the wearer is in a standing position. FIG. 2B depicts the exterior of the garment 200 while the wearer's arms are extended upwards. FIG. 2C depicts the exterior of the garment 200 as the wearers stands at a forward angle with the torso bent forward. The garment 200 is a sports bra comprising a bust panel 202 coupled to a waistband 204. A supportive outline 206 is stitched into the bust panel 202. The outline comprises two connected convex curves stitched into the fabric outlining at least a portion of the wearer's breasts. The stitched outline 206 is located near the waistband 204 of the garment 200. The bust panel 202 further comprises elongated underarm sections 208, 210 that extend coverage of the bust panel over the pectoral and latissimus dorsi muscles of the wearer.

In one embodiment, the bust panel covers the entirety of the sternal region of the wearer. One of ordinary skill in the art will understand the use of the phrase "sternal region" to mean the area of the body corresponding to the anatomical location of the sternum. It is advantageous to cover the sternal region of the wearer in a high-contact physical activity such as wrestling, as the garment provides an additional cushion to force applied to the sternum. When grappling, the sternum and chest is placed in close contact with the opponent. Thus, the padding of the garment not only supports a wearer's breasts but protects the wearer from impact to the chest. In one embodiment, the bust panel does not cover the entirety of the sternal region of the wearer. Further, the coverage provided by the garment of the present invention is significantly advantageous in sports such as wrestling. Wrestling requires anatomical positioning such as that of FIG. 2C which depicts a wearer in a neutral stance. In this stance the wearer is bent at the waist and significantly angled downward. It is advantageous to provide a garment that compresses the entirety of the chest region to prevent upward movement of a wearer's breast in such a position. Movement at this position creates tension in the spine, shoulders, and neck of the wearer. However, the coverage of the entirety of the wearer's chest and sternal region of the present invention advantageously reduces the strain placed on the spine, shoulders, and neck of the wearer. Further, the high neckline of the garment of the present invention advantageously prevents the skin from being scratched by an opponent in close contact activities.

The use of nonslip zones as described herein are advantageous in preventing a vasoconstrictive effect. The constriction of the waistband into the skin of the wearer creates a vasoconstrictive effect, limiting the flow of blood in vessels within the torso of the wearer. The torsional movement of the wrestler further increases the constriction of these veins. The inhibition of blood flow is disadvantageous to a wearer, particular in close contact sports. Lack of blood flow through the banded area of the torso is operable to cause cramping and numbness in the lower limbs, consequentially causing decreased reaction times as limbs become less responsive to movement. The garment of the present invention does not rely solely on the constriction of the elastic waistband to prevent movement of the garment on the skin. Thus, the compressive force required to prevent movement of the fabric on the skin of a wearer is decreased, and the vasoconstrictive effect is diminished. In one embodiment, the waistband of the garment is a linear elastic waistband. In one embodiment, the waistband is a scalloped edge design with alternating concave and convex curves.

In one embodiment, the bust panel of the garment of the present invention does not couple to underarm panels. Rather, the bust panel covers the underarm area of the wearer and couples to the waistband of the garment behind the back of the wearer, as depicted in FIG. 2E. In one embodiment, the bust panel is coupled to underarm panels as depicted in FIGS. 1A and 1C.

In one embodiment, the garment of the present invention includes one or more stitched support outlines. In one embodiment, the support stitching outline is a zigzag stitch. In one embodiment, the support stitching outlines at least a portion of the wearer's breasts. In one embodiment, the stitched outline is a single, continuous outline comprising two convex shapes connected over the sternum region of the wearer, located beneath the bust of the wearer. In one embodiment, the stitched outline comprises two individual convex curves stitched into the fabric below the bust of the wearer. In one embodiment, the support stitching outlines are linear seams located on the side of the bust panel, where the bust panel connects to each elongated underarm panel. In one embodiment, the seam that couples the elongated underarm panel to the bust panel functions as the stitched support outline. This use of stitched support seams is advantageous for providing support during physical activity, as each breast is secured into position. Thus, movement of a wearer's breasts during physical activity is decreased. Further, movement of the garment on the surface of the wearer is decreased.

The stitching of the outline is advantageous over compressive and similar methods of molding, as the stitching provides dynamic movement of the garment. Specifically, the compressed shapes of many prior art systems rely on heat and pressure to mold the fabric layers. This causes the layers to adhere to a desired shape. However, this compression decreases the width of the fabric layers along the line of the compressing. For garments used in repeated, extensive physical activity, the thinness of compressed shapes results in more frequent ripping and tearing of the garment along the edge of the compressed shape. Further, when donning or removing the garment, stretching of the garment is required. The flexible stitching of the outline of the present invention allows for movement of the fabric. The stitched outline contour the shape of the under bust region of the wearer, allowing for the fabric to move with the wearer and the stitches are flexed rather than forces the wearer to readjust during movement to accommodate the lack of flexibility in the compressed outline. In one embodiment, the outline of the present invention is not a compressed or molded outline. In one embodiment, the stitched outline does not extend upwardly towards the underarm sections of the bust panel. In one embodiment, the stitched support outline connects at the center of the bust panel over the sternum of a wearer in a parabolic shape over the sternal region of a wearer and stretches underneath a wearer's bust without curving upward toward the underarm section of the bust panel.

Figure 2D:
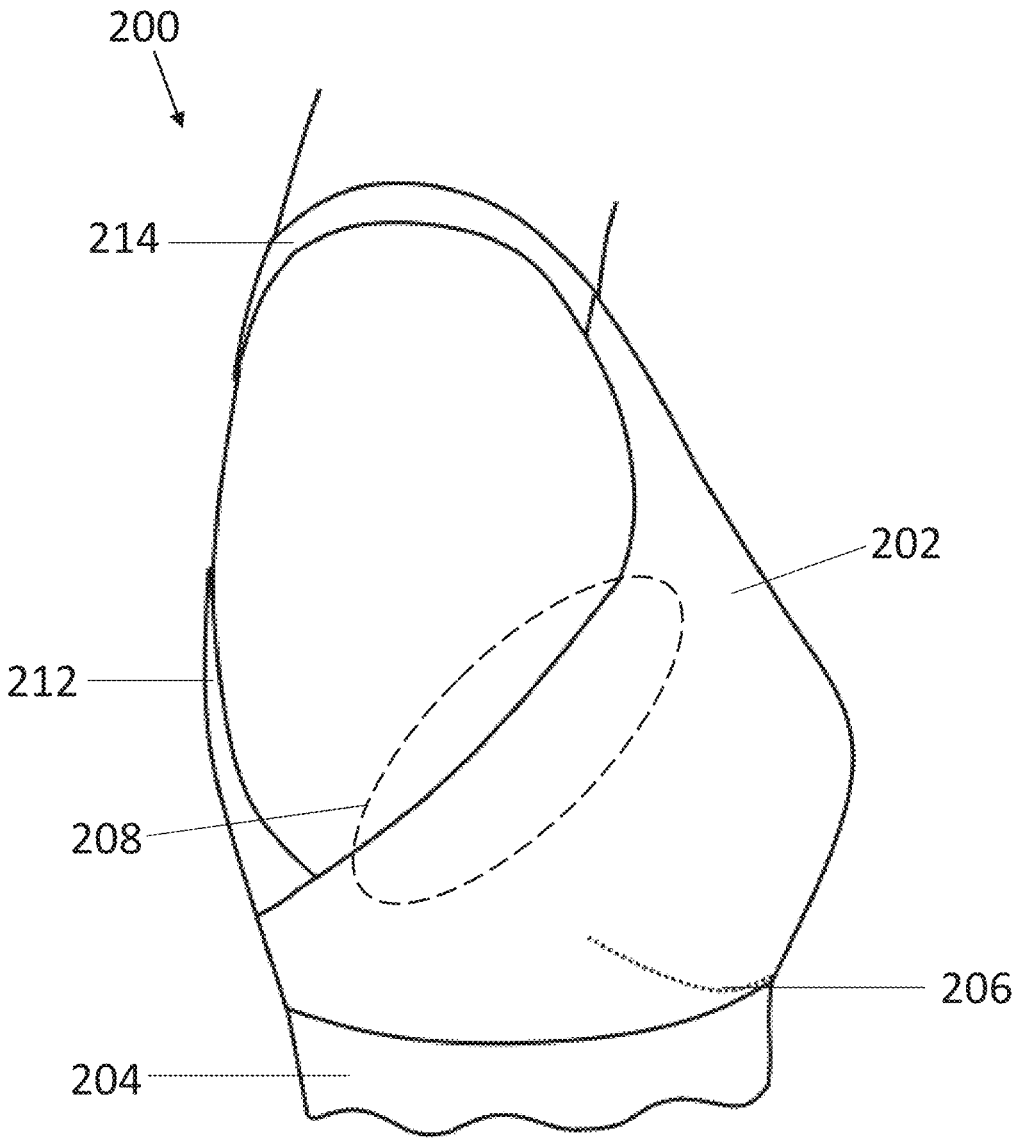
FIG. 2D illustrates an orthogonal view of the side of the garment on a body of a user according to one embodiment of the present invention.
Figure 2E:
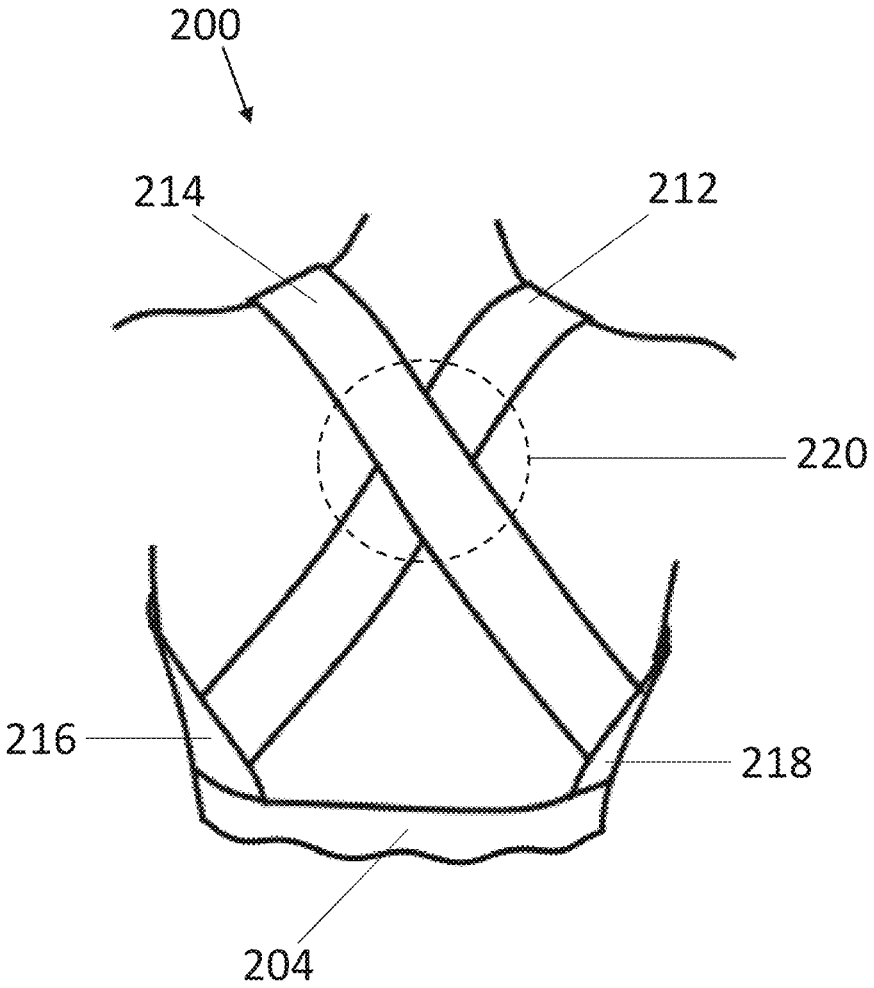
FIG. 2E illustrates an orthogonal view of the back of the garment on a body of a user according to one embodiment of the present invention.

FIG. 2D is an orthogonal view of the exterior of a garment according to one embodiment of the present invention. The garment comprises a bust panel 202 connected to a waist band 204. The stitched outline 206 extends from under the best of the wearer towards the elongated underarm section 208 of the bust panel. The elongated underarm section 208 angles downward from the front of the garment towards the bottom of a back strap 212. The top of a back strap 214 is coupled to the bust panel 202 and stretches over the trapezius muscle of the wearer.

The downward angle of the underarm section of the bust panel and/or underarm panel is advantageous in providing coverage for the side of a wearer's breasts while also allowing free movement of the lateral muscles of the wearer. In one embodiment, the underarm section extends from the anterior trapezius muscle, cover the pectoral muscle and stretching under the arm of the wearer. The elongated underarm section then stretches down towards the waist at an angle, covering a significant portion of the serratus anterior muscle to connect to the waistband. In one embodiment, the underarm section is angled between approximately 40 degrees and approximately 60 degrees from the waistband to the front facing side of a wearer's front facing underarm region. In one embodiment, the underarm section is angled between approximately 30 degrees and approximately 80 degrees from the waistband to the front facing side of a wearer's front facing underarm region. In one embodiment, the elongated underarm section of the present invention does not have an elastic hem. In one embodiment, the upper hemline of the elongated underarm section is not elastic.

FIG. 2E is an orthogonal view of the exterior of the back of the garment according to one embodiment of the present invention. The elongated underarm sections 216, 218 of the bust panel extend from the underarm area of the wearer at a downward angle to connect with the waistband 204. The back straps 212 and 214 stretch over the trapezius muscle of the wearer to connect to the elongated underarm sections 216 and 218 of the bust panel. Specifically, a first back strap 212 stretches over the shoulder of a wearer, crossing the anatomical midline of a wearer's body to couple with the elongated underarm section 216 located on the opposite side of the wearer's body. The interior surface of the first back strap 212 maintains contact with the skin of the wearer over the spine. A second back strap 214 stretches over the shoulder of a wearer, crossing the anatomical midline of a wearer's body to couple with the elongated underarm section 218 located on the opposite side of the wearer's body. The interior surface of the second back strap 214 contacts the exterior surface of the first back strap 212 over the spine, indicated by the intersection 220 of the back straps. The intersection 220 of the backstraps 212, 214 of the garment 200 is located over the spine.

In one embodiment, the back straps of the present invention are in a crisscross configuration, wherein a first back strap is not coupled to a second back strap. This is advantageous for allowing the free movement of a single scapula without further compressing the second scapula and associated muscles of a wearer. Wrestling often requires reaching a single arm out to initiate an attack on an opponent or fend off an advance. Using the garments provided by the prior art with a racerback design, the movement of one arm impacts the level of movement of the second arm. This is because the back of a racerback style sports bra is a single, solid piece of fabric which covers a section of the back. Moving one arm pulls the entire piece of fabric, thereby increasing the amount of force required to move a second arm as the movement of the second arm will stretch the single fabric piece in a second direction.

In one embodiment, the bust panel does not fully circumscribe the torso of the wearer. In one embodiment, the present invention comprises a bust panel and underarm panels that do not fully circumscribe the torso of the wearer. The bust panel and underarm panels are coupled to a waistband that fully circumscribes the torso of the wearer. In one embodiment, the sides of the bust panel are angled downward under the arm and coupled to the waistband. In one embodiment, the elongated underarm sections of the bust panels are coupled together. Wrestling movements such as takedowns, cradles, and attacks all require flexion and extension of the erector spinae, trapezius, and latissimus dorsi muscles, located on the back. These muscles are compressed by the traditional compressive design of the prior art. The present garment advantageously allows for the uninhibited movement of these muscle groups while maintaining coverage. In one embodiment, the upper hemline of the elongated side panel is not elastic. This is advantageous in further preventing constriction of blood flow and uncomfortable indentation into the skin. In one embodiment, the back of the garment does not cover more than 20% of the posterior torso region. In one embodiment, the space of skin not covered by the straps does not form a teardrop shape. In one embodiment, the back straps of the present invention specifically couple to the underarm panels rather than the coupling together.

Figure 3:
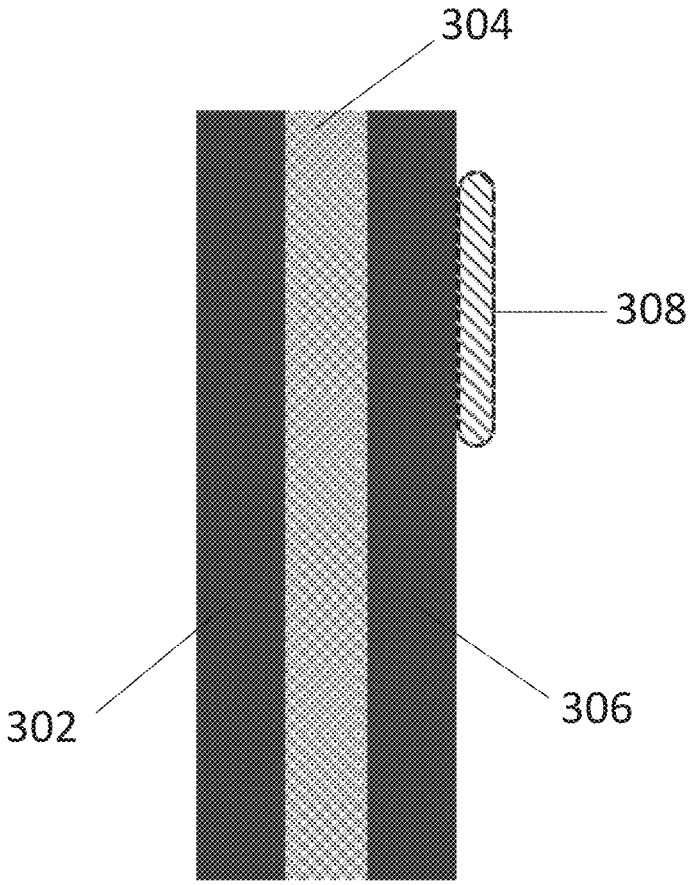
FIG. 3 illustrates a sectional view of the fabric of the garment according to one embodiment of the present invention.

FIG. 3 depicts the arrangement of fabric layers according to one embodiment of the present invention. A layer of padding 304 is situated between two layers of flexible fabric 302, 306. The exterior flexible fabric layer 302 comprises the exterior surface of the garment, while the interior flexible fabric layer 306 comprises the interior surface of the garment. The nonslip zone 308 is coupled to the interior flexible fabric layer 306.

In one embodiment, the bust panel is comprised of a layer of padding sandwiched between layers of stretchable fabric. In one embodiment, the padding is comprised of polyurethane foam. In one embodiment, padding layer is not a power mesh material. In embodiment, the padding is comprised of a layer of foam constructed of polyester, polyether, polystyrene, polyethylene, vinyl, or any combination thereof, including polyurethane. In one embodiment, the stretchable fabric is a blend of a hydrophobic textile and a hydrophilic textile. In one embodiment, the stretchable fabric is a blend of polyester and spandex fibers. In one embodiment, the stretchable fabric is a power mesh blend. In one embodiment, the stretchable fabric is a power mesh blend. One of ordinary skill in the art will appreciate that power mesh blends of fabric are comprised of thinner threads and are woven more loosely than a power mesh blend. In one embodiment, the underarm panels are a power mesh blend and the front panel is not a power mesh blend. In one embodiment, the bust panel is a power mesh blend and the underarm panels are not a power mesh blend. In one embodiment, the stretchable fabric is a blend of nylon and spandex fibers. In one embodiment, the stretchable fabric is 81% polyester and 19% spandex. In one embodiment, the stretchable fabric is 80% nylon and 20% spandex. In one embodiment, the stretchable fabric is 72% nylon and 28% spandex. In one embodiment, the flexible fabric is not a power mesh fabric. In one embodiment, the interior-most layer of stretchable fabric and the exterior most layer of stretchable fabric (relative to the skin of a wearer) are comprised of different fabric compositions. In one embodiment, the fiber blend is a moisture wicking blend, including but not limited to polyester, wool, polypropylene, spandex, LYCRA, bamboo, GORE-TEX, nylon, acrylic, modal, and/or rayon. It is advantageous to use a moisture wicking fabric as sweat generated as a result of the physical activity of the wearer is absorbed but not visible. In one embodiment, the interior flexible fabric layer is 80% nylon and 20% spandex. In one embodiment, the thread of the stitched support outline comprises 95% cotton and 5% spandex. In one embodiment, the fabric of the back straps comprises a blend of nylon, spandex, and neoprene. In one embodiment, the flexible fabric layers comprising the bust panel and underarm sections of the garment are a blend of nylon, spandex, and neoprene. In one embodiment, the garment of the present invention does not include a layer of padding. In one embodiment, the garment comprises a single piece of fabric that is cut to the fit of the garment (i.e., each portion of the garment is a unitary piece of fabric). In one embodiment, one or more portions of the garment are comprised of a unitary piece of fabric. In one embodiment, a first layer of fabric (i.e., either an internal or external layer) of the garment comprises a unitary piece of fabric while a second layer is comprised of the portions described herein.

In one embodiment, the stretchable fabric of the bust panel is the same composition of fibers as the stretchable fabric of the back straps. In one embodiment, the stretchable fabric of the bust panel is not the same composition of fibers as the stretchable fabric of the back straps. In one embodiment, the stretchable fabric of the bust panel, back straps, and waistband are composed of different compositions of fabric blends. In one embodiment, the bust panel and the underarm panels are composed of different compositions of fibers. In one embodiment, the bust panel and the underarm panels are composed of the same compositions of fiber. In one embodiment, the layers of fabric of the present garment are not adhered to each other. In one impediment, the exterior flexible fabric layer is not adhered to the layer of padding. In one impediment, the interior flexible fabric layer is not adhered to the layer of padding. In one embodiment, the exterior flexible fabric is coupled to the interior flexible fabric, wherein the foam padding is disposed within an open space formed by the coupled flexible fabric layers. In one embodiment, the fabric blend comprises cotton, polyester, nylon, spandex, polypropylene and/or wool fibers.

In one embodiment, the nonslip zone is comprised of a material with an increased coefficient of friction in comparison to the fabric of the garment. Examples of material with an increased coefficient of friction in comparison to the fabric include but are not limited to silicone, rubber, neoprene, and plastic. The nonslip zone contacts the skin of the wearer and prevents the fabric from moving against the skin when the wearer is in motion. This is advantageous for wrestling, as rapid movement of the limbs and torso necessitate the movement of the skin. For example, a wearer raises their arm, and the skin of the underarm moves upward. The nonslip zone grips the skin and moves the garment with the skin. When the arm is lowered, the nonslip zone maintains the position of the garment on the skin. Further, when a wearer bends forward, the nonslip zones prevent the movement of the garment, providing support and coverage to the wearer.

Figure 4A:
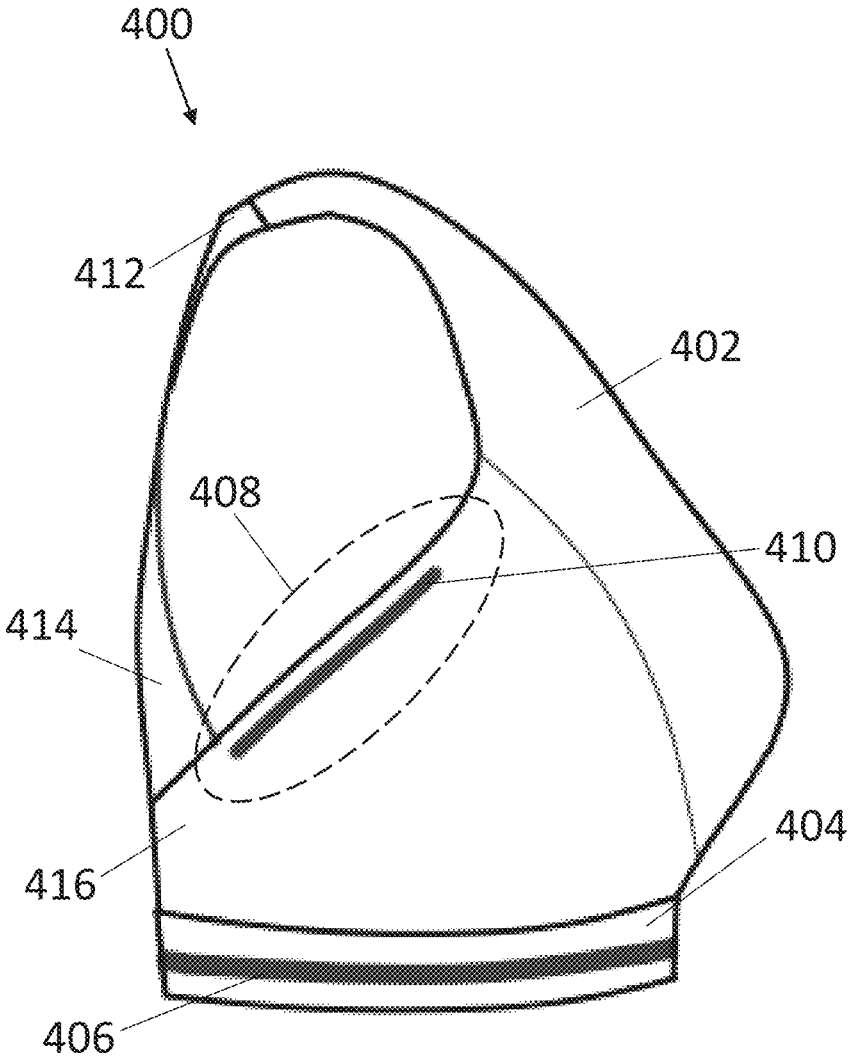
FIG. 4A illustrates a perspective view of the interior of the side of the garment according to one embodiment of the present invention.
Figure 4B:
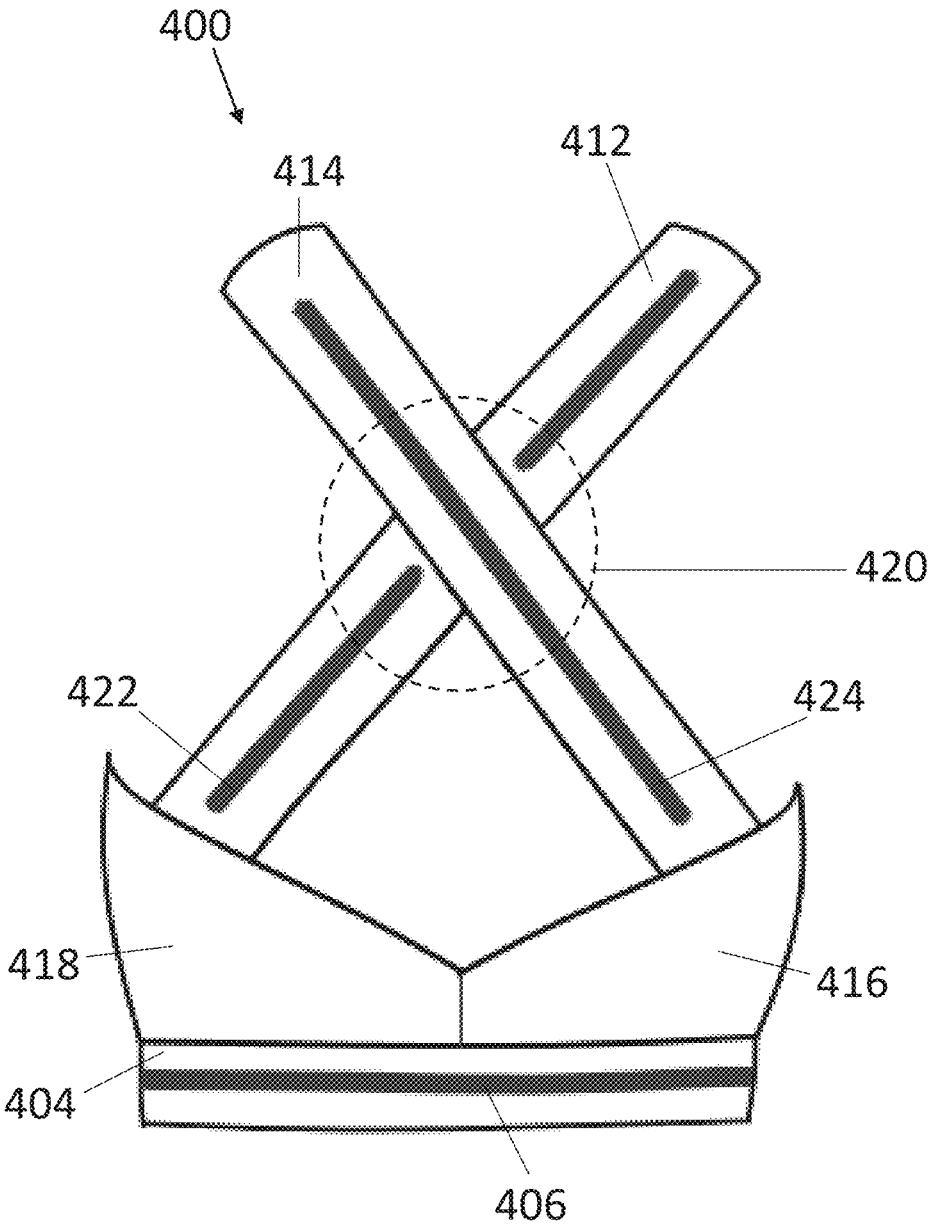
FIG. 4B illustrates a perspective view of the back of the garment according to one embodiment of the present invention.

FIGS. 4A and 4B depict the interior surface of a garment according to one embodiment of the present invention. FIG. 4A is an interior view of the side of the garment, while FIG. 4B is an interior view of the back of the garment. The garment 400 comprises the bust panel 402 coupled to the waistband 404, with the top of back strap 412 coupled to the bust panel 402 at the shoulder and the bottom of back strap 414 coupled to the elongated underarm panel 416. The underarm panel 416 is also coupled to the bust panel 402. The underarm nonslip zone 410 extends along the hemline of the elongated underarm panel 416, and the waistband nonslip zone 406 extends along the interior of the waistband 404. The elongated underarm section 408 of the underarm panel 416 extends coverage of the garment in comparison to existing garments.

FIG. 4B depicts an orthogonal view of the interior of the back of a garment according to one embodiment of the present invention. The garment comprises two back straps 410, 412 coupled to two elongated side sections 416, 418. Specifically, a first back strap 412 stretches over the shoulder of a wearer, crossing the anatomical midline of a wearer's body to couple with the elongated underarm panel 418 located on the opposite side of the wearer's body. A second back strap 414 stretches over the shoulder of a wearer, crossing the anatomical midline of a wearer's body to couple with the elongated underarm section 416 located on the opposite side of the wearer's body. The intersection 420 of the back straps 412, 414 of the garment 400 is located over the spine when the wearer is in a neutral position. A plurality of back strap nonslip zones 422, 424 are coupled to the interior surface of the back straps 412, 414. The waistband nonslip zone 406 is coupled to the interior surface of the waistband 404.

Figure 5A:
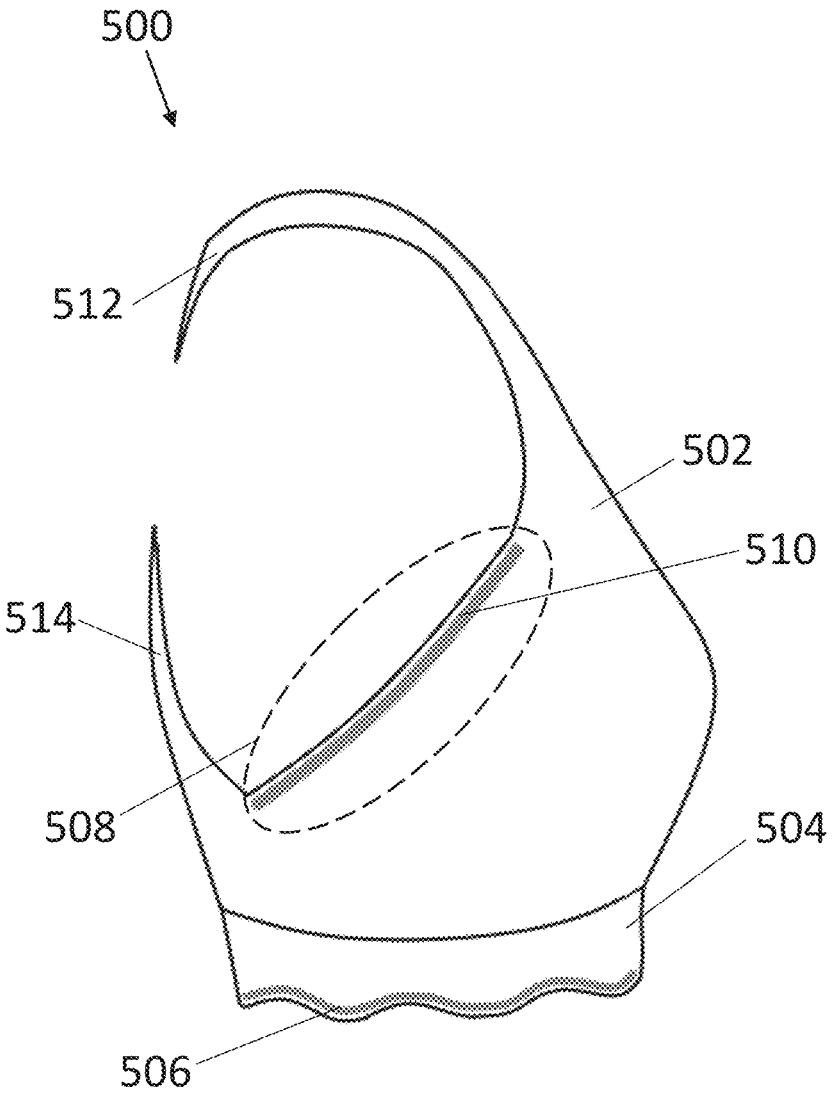
FIG. 5A illustrates an orthogonal view of the interior of the side of the garment according to one embodiment of the present invention.
Figure 5B:
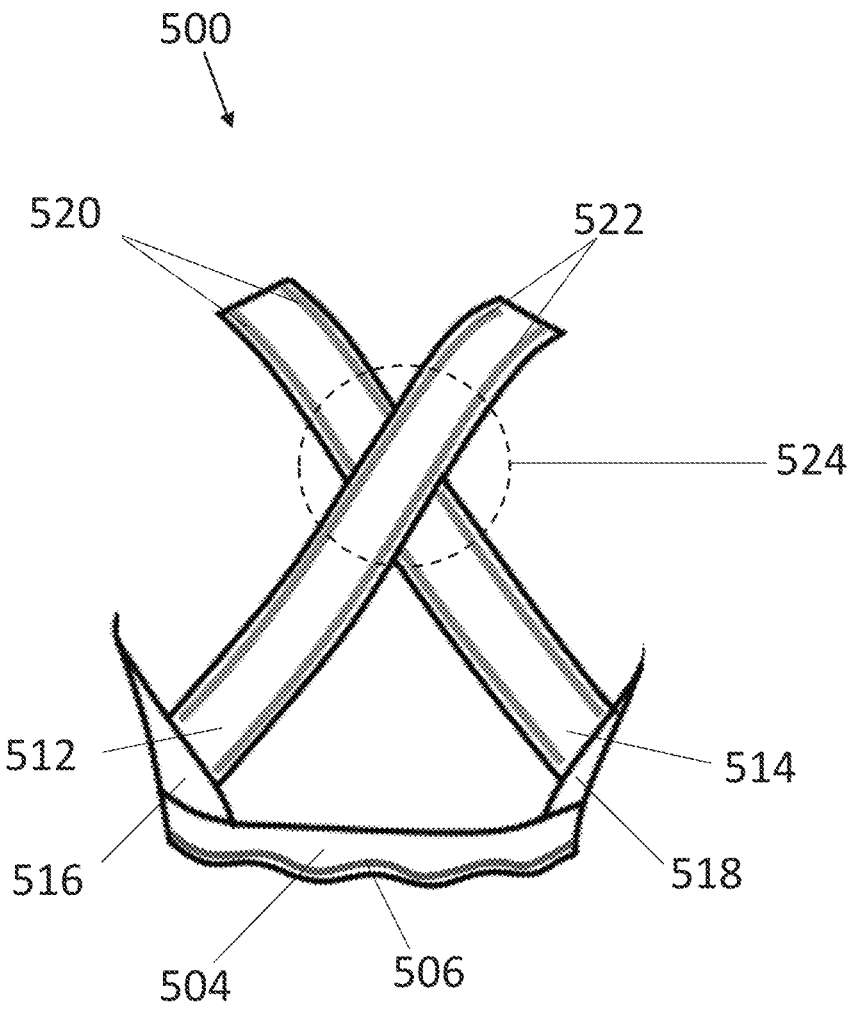
FIG. 5B illustrates an orthogonal view of the interior of the back of the garment according to one embodiment of the present invention.

FIGS. 5A and 5B depict the interior surface of a garment according to one embodiment of the present invention. FIG. 5A is an interior view of the side of the garment, while FIG. 4B is an interior view of the back of the garment. The garment 500 comprises the bust panel 502 coupled to the waistband 504, with the top of back strap 512 coupled to the bust panel 502 at the shoulder and the bottom of back strap 514 coupled to the elongated underarm section 508. The underarm nonslip zone 510 extends along the hemline of the elongated underarm section 508 of the bust panel 502, and the waistband nonslip zone 506 extends along the interior of the waistband 504.

FIG. 5B depicts an orthogonal view of the interior of the back of a garment according to one embodiment of the present invention. The garment comprises two back straps 512, 514 coupled to two elongated side sections 516, 518. Specifically, a first back strap 512 stretches over the shoulder of a wearer, crossing the anatomical midline of a wearer's body to couple with the elongated underarm section 516 located on the opposite side of the wearer's body. A second back strap 514 stretches over the shoulder of a wearer, crossing the anatomical midline of a wearer's body to couple with the elongated underarm section 518 located on the opposite side of the wearer's body. The intersection 524 of the back straps 512, 514 of the garment 500 is located over the spine. A plurality of back strap nonslip zones 520, 522 are coupled to the interior surface of the back straps 512, 514. The waistband nonslip zone 506 is coupled to the interior surface of the waistband 504.

In one embodiment, the garment of the present invention includes nonslip zones coupled to an interior surface of the garment. Interior surface is used herein to refer to the surface of the garment which faces inward to the skin of the wearer. The interior surface of the garment is operable to contact the skin of the wearer. In one embodiment, a nonslip zone is coupled to an interior surface of the garment, wherein the interior surface of the nonslip zone contacts the skin of the wearer and the exterior surface of the nonslip zone is coupled to the fabric of the garment. The nonslip zone prevents the movement of the fabric along the skin without relying on constrictive elastic hems on the underarm of the garment. As the wearer moves, the increased coefficient of friction of the nonslip zone maintains contact with the skin of the wearer and prevents the garment from resituating on the skin. In one embodiment, the garment includes a plurality of non-slip zone on the interior surface of the garment. The nonslip zone located on the waistband of the garment prevents the garment from shifting (i.e., "riding up") during movement of the wearer.

In one embodiment, the garment includes two underarm nonslip zones located on upper hem of each of the elongated underarm sections of the bust panel. In one embodiment, the garment includes two underarm nonslip zones located on upper hem of each of the elongated underarm panels. In one embodiment, the underarm nonslip zone extends along the entirety of the upper hem of each of the elongated underarm sections and/or underarm panels. In one embodiment, the nonslip zone extends along a portion of the upper hem of each of the elongated underarm sections and/or underarm panels. The nonslip zone located on the underarm section and/or panel advantageously prevents movement of the side of the garment in both neutral positions and in positions wherein the arm or arms of the wearer are stretched upwards (e.g., a "half Nelson" hold in wrestling). In one embodiment, there is a nonslip zone along the hemline of the waistband. In one embodiment, the waistband nonslip zone is scalloped. In one embodiment, the waistband nonslip zone is linear. In one embodiment, the design of the nonslip zone corresponds to the design of the garment hem to which it is coupled (e.g., a scalloped waistband and a scalloped nonslip zone). In one embodiment, the design of the nonslip zone does not correspond to the design of the garment hem to which it is coupled (e.g., a linear underarm hemline and a scalloped underarm nonslip zone).

The nonslip zone is advantageous for use with the individually moving back straps, as each strap grips the skin of the wearer to prevent the displacement of the back strap from the original placement on the body of the wearer. As one limb is moved, both strap stays in place. In one embodiment, each individual back strap includes a single nonslip zone. In one embodiment, each individual backstrap includes two nonslip zones. In one embodiment, the garment includes underarm nonslip zones, waistband nonslip zones, and backstrap nonslip zones. In one embodiment, the interior surface of the back straps does not include a nonslip zone. In one embodiment, backstraps of the garment are operable to include a single nonslip zone in the middle of the strap.

In one embodiment, the bust panel is approximately 8⅝ inches long from the neckline to the waistband. In one embodiment, the bust panel is approximately 10⅜ inches long from the neckline to the waistband. In one embodiment, the waist band is approximately 2 inches wide. In one embodiment, the garment is approximately 11 inches wide, measuring from the elongated section of one side of the garment to the elongated section of the opposite side. In one embodiment, the garment is approximately 9½ inches wide along the side of the garment (i.e., along the underarm panel). In one embodiment, the back straps are approximately 1½ inches wide.

In one embodiment, the underarm panel is approximately 7½ inches in height along the seam attaching the underarm panel to the bust panel inches and gradually decreases in height as the underarm panel is stretched around the side of the wearer to a height of approximately 1½ inches at the seam connecting to the two underarm panels. In one embodiment, the backstraps are approximately 5 inches apart, from the medial end of the seam connecting the first backstrap to the first underarm panel to the medial end of the seam connecting the second backstrap to the second underarm panel. In one embodiment, the backstraps are approximately 3 inches apart. In one embodiment, the backstraps are approximately 2 inches apart. In one embodiment, the backstraps are approximately 6½ inches apart. In one embodiment, the backstraps are approximately 0.5, 1, 1.5, 2, 2.5, 3, 3.5, 4, 4.5, 5, 5.5, 6, 6.5, 7, 7.5, 8, 8.5, 9, 9.5, or 10 inches apart. In one embodiment, the backstraps are equidistant from a vertical midline of the garment.

In one embodiment, the waistband circumscribes the torso of the wearer around the midpoint of the torso of the wearer. In one embodiment, the waistband circumscribes the natural waist of the wearer (i.e., the area of the torso between the bottom rib and top of the hips of the wearer). In one embodiment, the garment is approximately 12½ inches in height, measuring from the neckline of the bust panel to the bottom hemline of the waistband down the midline of the body of the wearer.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A garment for chest compression and support, comprising:

a bust panel;

a waistband;

a first underarm panel and a second underarm panel; and a first back strap and a second back strap;

wherein the bust panel comprises a first layer, a second layer, and a third layer, wherein the first layer and the third layer comprises a stretchable fabric and the second layer comprises a padding material;

wherein the bust panel further comprises a continuous stitched outline of an under bust region of the garment;

wherein the first backstrap is not coupled to the second backstrap, wherein the first back strap moves independently of the second backstrap in a crisscross orientation;

wherein the waistband fully encircles a waist of a wearer;

wherein the waistband comprises a scalloped edge;

wherein the first underarm panel is coupled to the waistband and coupled to the bust panel at an angle of about 40 degrees relative to the waistband, wherein the second underarm panel is coupled to a side of the bust panel at an angle of about 40 degrees relative to the waistband opposite the first underarm panel;

wherein the first underarm panel is not coupled to the second underarm panel;

wherein the first backstrap is coupled to the first underarm panel and the second backstrap is coupled to the second underarm panel; and wherein the garment includes at least one nonslip zone along a perimeter of the waistband, the first backstrap, and the second backstrap, wherein the nonslip zone comprises a fabric with a higher coefficient of friction than the stretchable fabric.

2. The garment of claim 1, wherein the bust panel covers a sternal region of the wearer.

3. The garment of claim 1, wherein the stretchable fabric includes at least one component selected from the group consisting of: nylon, spandex, rayon, polyester, and polypropylene.

4. The garment of claim 1, wherein the padding material is polyurethane.

5. The garment of claim 1, wherein the padding material is not a power mesh blend.

6. The garment of claim 1, wherein the second layer is not adhered to the first layer or the third layer, wherein the first layer is not adhered to the third layer.

7. A garment for chest compression and support, comprising:

a bust panel;

a waistband;

a first underarm panel with a first elongated section;

a second underarm panel with a second elongated section; and a first back strap and a second back strap;

wherein the bust panel comprises a first layer, a second layer, and a third layer, wherein the first layer and the third layer comprises a stretchable fabric and the second layer comprises polyurethane padding;

wherein the bust panel further comprises a continuous stitched outline of an under bust region of the garment;

wherein the first backstrap is not coupled to the second backstrap, wherein the first back strap moves independently of the second backstrap in a crisscross orientation;

wherein the waistband fully encircles a waist of a wearer;

wherein the waistband comprises a scalloped edge;

wherein the first underarm panel is coupled to the waistband and coupled to the bust panel at an angle of about 40 degrees relative to the waistband, wherein the second underarm panel is coupled at an angle of about 40 degrees relative to the waistband to a side of the bust panel opposite the first underarm panel;

wherein the first underarm panel is not coupled to the second underarm panel;

wherein the first elongated section extends upward from the first underarm panel, wherein the second elongated section extends upward from the second underarm panel;

wherein the first backstrap is coupled to the first underarm panel and the second backstrap is coupled to the second underarm panel;

wherein the garment includes a plurality of nonslip zones, wherein each of the plurality of nonslip zones comprise a fabric with a higher coefficient of friction than the stretchable fabric;

wherein a first nonslip zone of the plurality of nonslip zones is located on the hemline of the first elongated section;

wherein a second nonslip zone of the plurality of nonslip zones is located on the hemline of the second elongated section;

wherein a third nonslip zone of the plurality of nonslip zones is located on a perimeter of the first back strap; and wherein a fourth nonslip zone of the plurality of nonslip zones is located on a perimeter of the second back strap.

8. The garment of claim 7, wherein the first elongated section and the second elongated section do not comprise an elastic upper hem.

9. The garment of claim 7, wherein the stretchable fabric includes at least one component selected from the group consisting of: nylon, spandex, rayon, polyester, and polypropylene.

10. The garment of claim 7, wherein the padding material is polyurethane.

11. The garment of claim 7, wherein the padding material is not a power mesh blend.

12. The garment of claim 7, wherein the second layer is not adhered to the first layer or the third layer, wherein the first layer is not adhered to the third layer.

13. A garment for chest compression and support, comprising:

a bust panel;

a waistband;

a first underarm panel with a first elongated section;

a second underarm panel with a second elongated section; and a first back strap and a second back strap;

wherein the bust panel comprises a first layer, a second layer, and a third layer, wherein the first layer comprises a stretchable fabric, the second layer comprises polyurethane padding, and the third layer comprises a moisture-wicking fabric;

wherein the bust panel further comprises a continuous stitched outline of an under bust region of the garment;

wherein the bust panel further comprises a neckline, wherein the neckline of the bust panel is coupled to the first back strap and the second back strap;

wherein the first backstrap is not coupled to the second backstrap, wherein the first back strap moves independently of the second backstrap in a crisscross orientation;

wherein the waistband fully encircles a waist of a wearer, wherein the waistband comprises an elastic fabric, wherein an inferior edge of the waistband is scalloped;

wherein the first underarm panel is coupled to the waistband and coupled to the bust panel at an angle of about 40 degrees relative to the waistband, wherein the second underarm panel is coupled at an angle of about 40 degrees relative to the waistband to a side of the bust panel opposite the first underarm panel;

wherein the first underarm panel is not coupled to the second underarm panel;

wherein the first elongated section extends upward from the first underarm panel, wherein the second elongated section extends upward from the second underarm panel;

wherein the first backstrap is coupled to the first underarm panel and the second backstrap is coupled to the second underarm panel;

wherein the garment includes a plurality of nonslip zones, wherein each of the plurality of nonslip zones comprise a fabric with a higher coefficient of friction than the stretchable fabric;

wherein a first nonslip zone of the plurality of nonslip zones is located on the hemline of the first elongated section;

wherein a second nonslip zone of the plurality of nonslip zones is located on the hemline of the second elongated section;

wherein a third nonslip zone of the plurality of nonslip zones is located on a perimeter of the first back strap; and wherein a fourth nonslip zone of the plurality of nonslip zones is located on a perimeter of the second back strap.

14. The garment of claim 13, wherein the stretchable fabric includes at least one component selected from the group consisting of: nylon, spandex, rayon, polyester, and polypropylene.

15. The garment of claim 13, wherein the padding material is polyurethane.

16. The garment of claim 13, wherein the padding material is not a power mesh blend.

17. The garment of claim 13, wherein the moisture-wicking fabric includes at least one component selected from the group consisting of polyester, polypropylene, spandex, bamboo, nylon, acrylic, modal, and rayon.

18. The garment of claim 13, wherein the second layer is not adhered to the first layer or the third layer, wherein the first layer is not adhered to the third layer.

* * * * *